United States Patent [19]

Selam

[11] 4,039,916

[45] Aug. 2, 1977

[54] DEVICE FOR PRECLUDING A COLLISION BETWEEN A MOBILE OBJECT AND A FIXED OR MOBILE OBSTACLE

[76] Inventor: Gabriel Selam, 161, Boulevard Edouard Vaillant, 93 Aubervilliers, France

[21] Appl. No.: 569,266

[22] Filed: Apr. 18, 1975

Related U.S. Application Data

[63] Continuation-in-part of Ser. No. 405,108, Oct. 10, 1973, abandoned.

[30] Foreign Application Priority Data

Oct. 10, 1972 France ..... 72.35816

[51] Int. Cl.[2] ..... G08D 1/00

[52] U.S. Cl. ..... 318/587; 180/98; 246/41

[58] Field of Search ..... 340/282, 177; 318/587; 180/98; 246/41, 58, 59, 73, 122 R, 122 A, 167 D; 104/147 A, 153

[56] References Cited

U.S. PATENT DOCUMENTS

| | | | |
|---|---|---|---|
| 2,735,302 | 2/1956 | Saylor | 340/177 R |
| 2,968,805 | 1/1961 | Sikorra | 340/177 R |
| 3,217,158 | 11/1965 | Ehrlich | 246/41 |
| 3,412,391 | 11/1968 | Ward | 340/282 |
| 3,817,344 | 6/1974 | Asano et al. | 180/98 |

FOREIGN PATENT DOCUMENTS

| | | | |
|---|---|---|---|
| 2,215,666 | 4/1973 | Germany | 318/587 |

*Primary Examiner*—Robert K. Schaefer
*Assistant Examiner*—John J. Feldhaus
*Attorney, Agent, or Firm*—Eric P. Schellin

[57] ABSTRACT

The device precludes a collision between a mobile object moving in a predetermined path and a second object in the same path. It comprises a sensor carried by the mobile object which cooperates with a fixed tape disposed along the path. The tape carries a track which has two conductive bands having a predetermined resistivity and the sensor comprises a series circuit having a source of voltage, a threshold circuit, and a wiper element in contact with the bands so as to connect them in series in the circuit.

9 Claims, 5 Drawing Figures

DEVICE FOR PRECLUDING A COLLISION BETWEEN A MOBILE OBJECT AND A FIXED OR MOBILE OBSTACLE

This application is a continuation-in-part of U.S. Patent Application Ser. No. 405,108, now abandoned filed Oct. 10, 1973.

The present invention relates to the control of the movement of mobile objects of large size, such as travelling cranes. More particularly, the invention relates to an anticollision device for precluding a collision of such a mobile object with another object or with some fixed obstacle in its path.

Presently-known devices of this type are based on optical detection or a detection employing hertzian means. Devices of both types have the drawback of being excessively sensitive to the surrounding conditions such as the vibrations of the mobile object, the high speed of the latter, or to smoke, vapors, excessively dark or light zones due to reverberation or reflection, or by the mere interruption of the detecting beam. Moreover, most of these known devices act in an off-on manner and produce stoppages which are too sudden, since they merely cut off the supply of the electric motors driving the mobile object.

An object of the present invention is to provide an anticollision device which avoids the aforementioned drawbacks.

The invention provides a device for precluding a collision between a mobile object moving in a predetermined path and another fixed or mobile object in said path, said mobile object comprising a sensor carried by the mobile object which cooperates with a fixed tape disposed along the path. Said tape comprises a track which has two conductive bands having a predetermined resistivity, and the sensor comprises a series circuit having a source of voltage, a threshold circuit, and a wiper element in contact with the bands so as to connect them in series in said circuit.

Further features and advantages of the invention will be apparent from the ensuing description with reference to the accompanying drawings.

In the illustrated embodiment, the device according to the invention is designed to preclude a collision between two mobile objects (not shown) which move in a common path. It can concern, for example, two travelling cranes having the same runway; However, it should be understood that the anticollision device may also be employed to preclude a collision between a single mobile object and any fixed obstacle.

Figure 1:
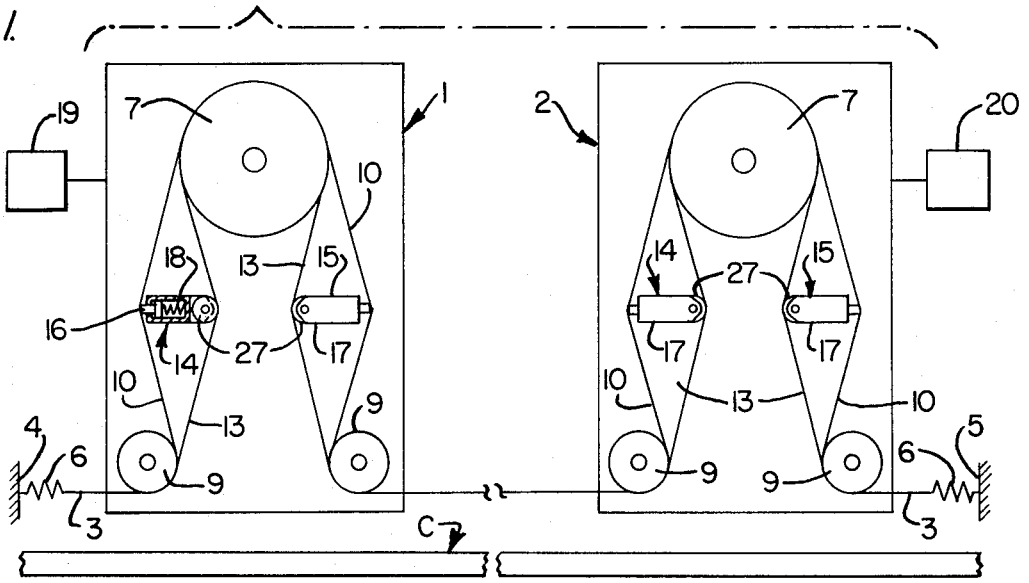
FIG. 1 is a diagrammatic view of two devices according to the invention comprising movement sensors mounted respectively on two mobile objects moving in the same path.

FIG. 1 shows that the device comprises two movement sensors 1 and 2 respectively carried by the two mobile objects.

Each of these sensors cooperates with a tape or strip 3 which is disposed along the runway C of the mobile objects and is attached to two fixed points 4 and 5 by its end portions, preferably by means of resiliently yieldable tension means 6. A more detailed description of the sensors and of this tape may be had from U.S. patent application Ser. No. 381,070 filed on July 20, 1973.

Figure 2:
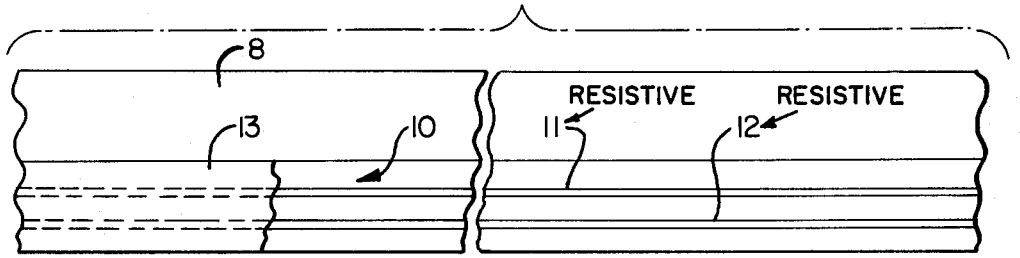
FIG. 2 is a partial plan view of a tape employed in the device shown in FIG. 1.
Figure 3:
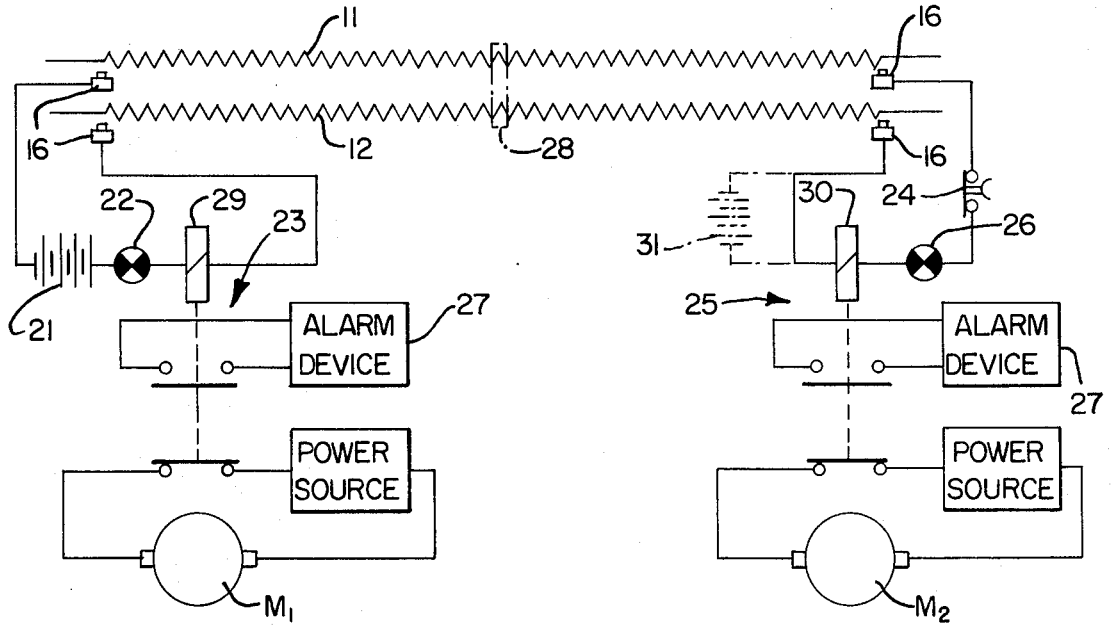
FIG. 3 is an electric diagram of the device according to the invention.

Each sensor comprises a detecting wheel 7 adapted to detect the information relating to the operation of the mobile object under consideration (information relating to the speed and to periodical and other stoppages). This information is recorded on a track 8 of the tape (FIG. 2). It will be appreciated that the information carried by track 8 of tape 3 may be magnetic or optical in nature. Of course, the detection means here utilized would be chosen to be compatible with the form of the information to be detected. In each sensor, the tape 3 passes around two guide pulleys 9.

The tape 3 has a second track 10 which is more particularly part of the device according to the invention. This track 10 has two conductive bands 11 and 12 consisting of a material having a predetermined resistivity per unit length. A protective tape or strip 13 which is separable from the tape 13 is placed over the conductive bands 11 and 12.

Each sensor further comprises two wiper elements 14 and 15, respectively adapted to cooperate with the conductive bands 11 and 12. Each wiper element comprises a brush or head 16 which is in contact with the corresponding band of the tape 3 and is slidably carried in a mount 17. A spring 18 affords the required force of contact. It will be understood that the wiper elements 14 and 15 are fixed to the sensors 1 and 2 in different vertical planes so as to scan the corresponding conductive bands.

The conductive bands 11 and 12 are a part of a circuit which includes these conductive bands 11 and 12 as resistive elements connected in series with a source of voltage 21, an indicator light 22, a threshold circuit 23, a control switch 24, a second threshold circuit 25 and a second indicator light 26, the latter elements being associated with the sensor 2.

As a portion of the tape 3 passes through the sensors 1 and 2, the corresponding portion of protective tape 13 is separated from the track 10 and passes over a guide roller 27, the wiping elements 14 and 15 being then interposed between this track and the protective tape 13.

The conductive bands 11 and 12 may be secured to the tape 3 by any process, for example a coating process, or may be inserted therein.

It will be understood that the conductive bands 11 and 12 represent a certain ohmic resistance, the value of which is proportional to the distance between the two mobile objects. The resistance in question determines the current in the series circuit described hereinbefore and, when the intensivity of this current increases above a certain value, the threshold circuits are capable of setting off an alarm such as sound or light alarm device. These threshold circuits comprise, for example, a simple relay which also permits producing the stoppage of the mobile objects by acting on the circuits of the motors $M_1$ and $M_2$ driving the latter.

In the preferred embodiment of the invention, each threshold circuit comprises a relay 29 and 30 respectively. The relays are series connected with a source of voltage and with the conductive bands 11 and 12. In the absence of short-circuit slider 28, the approach of the mobile objects toward one another reduces the resistive value between the respective pairs of wipers 16 increasing the current flow in the circuit. At a given distance, the current value will increase sufficiently to energize both relays 29 and 30. In that the relays will trip at a given current value in their windings, they actually act as a limit switch, their energization being followed by the interrupting of the respective circuits of motors $M_1$ and $M_2$, and by the triggering of an alarm.

The threshold circuits may also comprise a digital or analog voltmeter coupled to the logic circuits which may, moreover, be those associated with the information track 8, the stopping procedure at a given output of the threshold circuit being that described in the aforementioned patent application.

The indicator lights 22 and 26 signal any breakage of the series circuit of the device and the switch 24 is adapted to put the device out of service, for example, to permit an approach which sets off the alarm signal during this control to warn the user.

When the device is employed as an anticollision device to preclude a collision with a fixed obstacle, only a single sensor associated with a single threshold circuit is employed. In this case, the bands 11, 12 must be short-circuited at the end thereof adjacent the fixed obstacle.

It is also possible to provide one or more short-circuit sliders 28 which are adapted to be placed on the conductive bands 11 and 12 at predetermined positions in the runway C. An auxiliary source of voltage 31 is required when short circuiting sliders 28 are used. In this case, the stoppage of the mobile objects will be achieved at a predetermined distance from the first slider 28 encountered in its path. In this way, certain zones of the runway C may be temporarily or permanently forbidden to the mobile objects.

Figure 4:
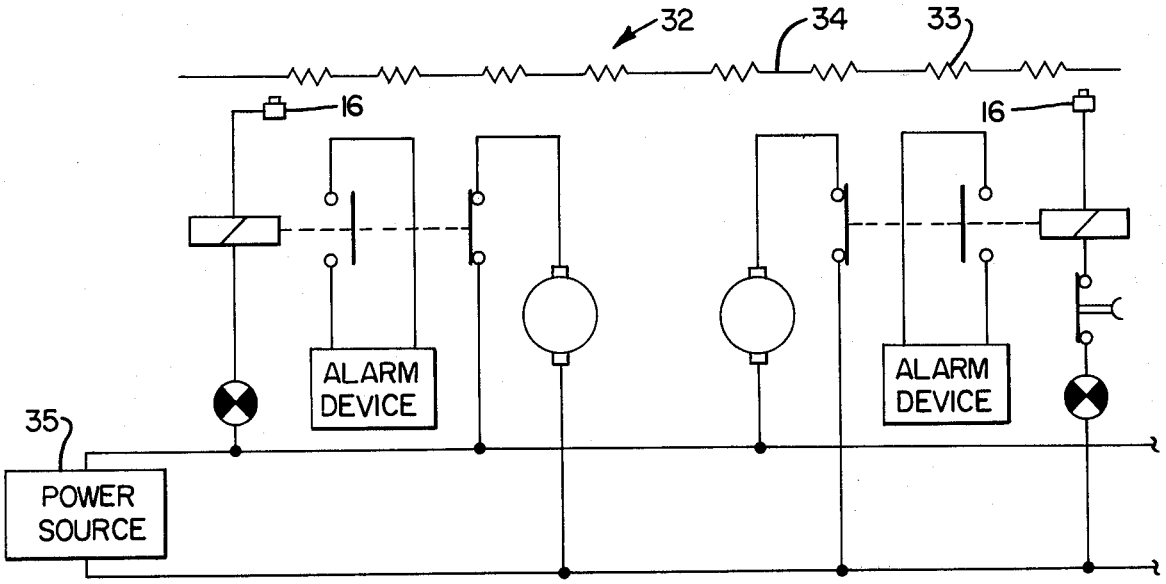
FIG. 4 is an electric diagram of an alternate embodiment of the invention wherein only one conductor band is required.

FIG. 4 shows a further embodiment of the invention wherein only one conductive band 32 is required. This band is formed by resistive portions 33 interconnected by portions 34 which may be copper or other high conductivity material. The resistive portions 33 are contacted by wiper element 16 and the source of voltage is the main supply 35 which also supplies the motors of the mobile objects.

Figure 4A:
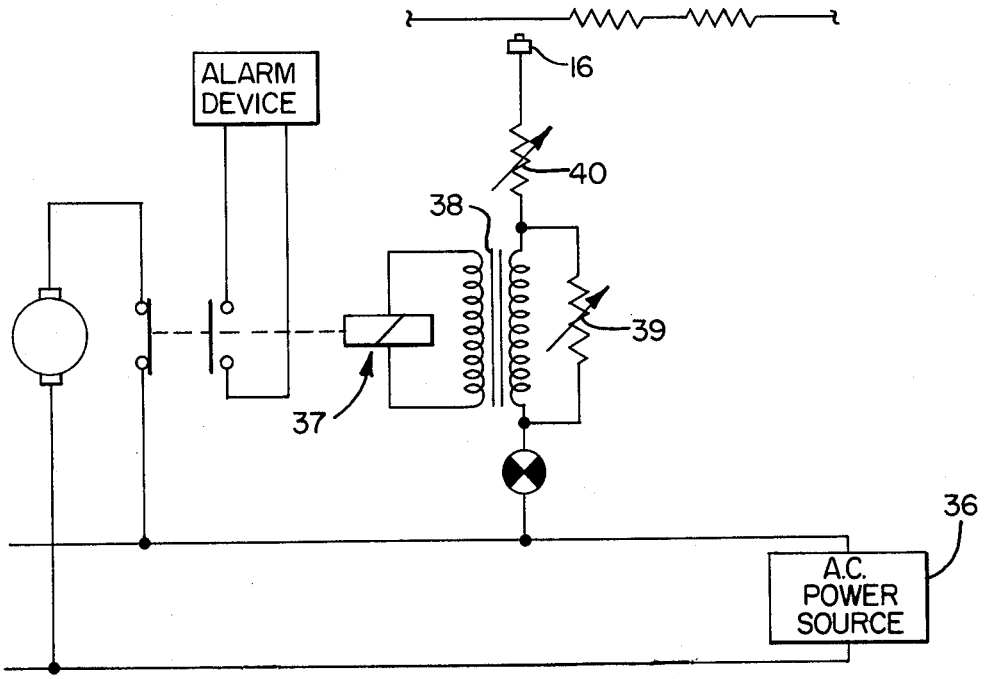
FIG. 4A is a further alternate embodiment wherein an AC voltage source is used.

FIG. 4A shows a further embodiment of the invention wherein the source of voltage may be an AC source 36. The operating power for the relay 37 can now be supplied over transformer 38. Further, variable resistor 39 is provided for adjusting the energizing threshold of relay 37. Variable resistor 40 is provided for adjusting the minimum distance between the mobile objects, at which distance the mobile objects come to rest.

Having now described my invention, what I claim as new and desire to secure by Letters Patent is:

1. A device for precluding a collision between a mobile object moving in a predetermined path and a second object in the same path, the mobile object including a motor, a source of power for said motor, and a means for interrupting the supply of power from said source to said motor, the device comprising a fixed tape disposed along the path and a sensor carried by the mobile object, said fixed tape comprising a track which has a band having a predetermined resistivity, the sensor comprising a series circuit having a source of voltage, a limit switch comprising the means for interrupting the supply of power, and a wiping means for electrically contacting the band so as to connect said band in series in said circuit, said limit switch interrupting said supply of power from said source to said motor when the resistance presented in said series circuit by said band is reduced to a predetermined value.

2. A device as claimed in claim 1, wherein a protective tape overlies said resistive band and said sensor comprises means for separating the protective tape from the band.

3. A device as claimed in claim 1, wherein there is provided a second wiping means and said track comprises two conductive bands, said wiping means comprising brushes resiliently yieldably biased respectively against said conductive bands.

4. A device as claimed in claim 1, wherein said second object is mobile and there is provided a second sensor comprising its own power interrupting means and a wiping means, the circuitry being such that said source of voltage, said limit switch of the first sensor, the conductive band, and the power interrupting means of the second sensor, are all connected in series through the two wiping means.

5. A device as claimed in claim 4, wherein at least one indicator light means is connected for indicating a break in said series circuit.

6. A device as claimed in claim 4, wherein a manually actuated switch means for interrupting the operation of the device is connected in series in said circuitry.

7. A device as claimed in claim 1, wherein said track comprises two conductive bands and further comprising at least one slider for short-circuiting said conductive bands in a previously chosen location.

8. A device as claimed in claim 1, wherein said band comprises a series of resistive portions interconnected by conductive portions.

9. A device for precluding a collision between a mobile object moving in a predetermined path and a second object in the same path, the mobile object including a motor, a source of power for said motor, and a threshold means for interrupting the supply of power from said source to said motor, the device comprising a fixed tape disposed along the path and a sensor carried by the mobile object, said fixed tape comprising a track having a band of predetermined resistivity, and the sensor comprising a series circuit including the threshold means, and a wiping means for electrically contacting the band connecting said band in series in said circuit, said source of power for said motor additionally providing power for said sensor, said source of power being an AC source.

* * * * *